US008830155B2

(12) United States Patent
Hsu et al.

(10) Patent No.: US 8,830,155 B2
(45) Date of Patent: Sep. 9, 2014

(54) METHOD AND SOURCE DRIVER FOR DRIVING LIQUID CRYSTAL DISPLAY

(75) Inventors: Chao-Ching Hsu, Hsinchu (TW); Jen-Chieh Chen, Hsinchu (TW); Mu-Lin Tung, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 1209 days.

(21) Appl. No.: 12/609,573

(22) Filed: Oct. 30, 2009

(65) Prior Publication Data

US 2011/0102471 A1 May 5, 2011

(51) Int. Cl.
*G09G 3/36* (2006.01)

(52) U.S. Cl.
CPC ..... *G09G 3/3614* (2013.01); *G09G 2320/0686* (2013.01); *G09G 2310/0213* (2013.01); *G09G 2320/0247* (2013.01); *G09G 2310/0297* (2013.01); *G09G 2330/021* (2013.01); *G09G 2360/16* (2013.01)
USPC ..... 345/100

(58) Field of Classification Search
USPC ..... 345/87–104
See application file for complete search history.

(56) References Cited

U.S. PATENT DOCUMENTS

| | | | | |
|---|---|---|---|---|
| 5,438,342 | A * | 8/1995 | Yamaguchi | 345/58 |
| 5,949,396 | A | 9/1999 | Lee | |
| 8,068,080 | B2 | 11/2011 | Nishimura | |
| 2003/0025684 | A1 * | 2/2003 | Chiang et al. | 345/204 |
| 2003/0227428 | A1 | 12/2003 | Nose | |
| 2004/0104880 | A1 * | 6/2004 | Kang et al. | 345/94 |
| 2004/0239602 | A1 * | 12/2004 | Kim et al. | 345/87 |
| 2005/0258780 | A1 * | 11/2005 | Chen | 315/291 |
| 2006/0022929 | A1 | 2/2006 | Hashimoto et al. | |
| 2006/0092120 | A1 | 5/2006 | Nose | |
| 2007/0085810 | A1 * | 4/2007 | Lee et al. | 345/100 |
| 2009/0310077 | A1 * | 12/2009 | Kim et al. | 349/151 |

FOREIGN PATENT DOCUMENTS

| | | | |
|---|---|---|---|
| CN | 1728230 | A | 2/2006 |
| CN | 1766983 | A | 5/2006 |
| CN | 100377203 | C | 3/2008 |
| CN | 101312021 | A | 11/2008 |
| CN | 100446078 | C | 12/2008 |
| EP | 2075788 | A2 | 7/2009 |
| JP | 2000305534 | A | 11/2000 |

(Continued)

*Primary Examiner* — Chanh Nguyen
*Assistant Examiner* — Sanghyuk Park
(74) *Attorney, Agent, or Firm* — Tim Tingkang Xia, Esq.; Morris Manning & Martin, LLP

(57) ABSTRACT

The present invention in one aspect relates to a source driver for driving a display panel to display an image data in an adaptive column inversion. In one embodiment, the source driver includes a data processing unit having a logic circuit adapted for determining N most-significant bits (MSBs) of image data signals of two neighboring data lines, such that when all of the N MSBs are equal to 1 or 0, the output of the logic circuit is 1, otherwise, the output of the logic circuit is 0, and a MUX coupled to the data processing unit and adapted for receiving a frame polarity control signal, FramePOL, and a pixel polarity control signal, XPOL, and selectively outputting the frame polarity control signal FramePOL when the output of the logic circuit is 1, or the pixel polarity control signal POL when the output of the logic circuit is 0, as a polarity control signal, POL.

19 Claims, 7 Drawing Sheets

(56) References Cited

FOREIGN PATENT DOCUMENTS

| | | | |
|---|---|---|---|
| JP | 2005215591 | A | 8/2005 |
| JP | 2006126475 | A | 5/2006 |
| TW | I294604 | B | 3/2008 |
| TW | I307871 | B | 3/2009 |

* cited by examiner

| S1 | S2 | S3 | S4 |
|---|---|---|---|
| + | - | + | - |
| + | - | + | - |
| - | + | - | + |
| - | + | - | + |

(a)

| S1 | S2 | S3 | S4 |
|---|---|---|---|
| + | - | + | - |
| + | - | + | - |
| - | - | - | + |
| - | - | - | + |

(b)

Fig. 3

METHOD AND SOURCE DRIVER FOR DRIVING LIQUID CRYSTAL DISPLAY

FIELD OF THE INVENTION

The present invention relates generally to a liquid crystal display (LCD), and more particularly, to a source driver of a display panel for displaying an image data in an adaptive column inversion and methods of driving same.

BACKGROUND OF THE INVENTION

Liquid crystal display (LCD) is commonly used as a display device because of its capability of displaying images with good quality while using little power. An LCD apparatus includes an LCD panel formed with liquid crystal cells and pixel elements with each associating with a corresponding liquid crystal cell and having a liquid crystal capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, scanning signals, generated from a gate driver, are sequentially applied to the number of pixel rows, through a plurality of scanning lines along the row direction, for sequentially turning on the pixel elements row-by-row. When a scanning signal is applied to a pixel row to turn on corresponding TFTs of the pixel elements of a pixel row, source signals of an image to be displayed, generated from a source driver, for the pixel row are simultaneously applied to the number of pixel columns, through a plurality of data lines arranged crossing over the plurality of scanning lines along the column direction, so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

Liquid crystal molecules have a definite orientational alignment as a result of their long, thin shapes. The orientations of liquid crystal molecules in liquid crystal cells of an LCD panel play a crucial role in the transmittance of light therethrough. It is known if a substantially high voltage is applied between the liquid crystal layer for a long period of time, the optical transmission characteristics of the liquid crystal molecules may change. This change may be permanent, causing an irreversible degradation in the display quality of the LCD panel. To prevent the LC molecules from being deteriorated, the polarity of the voltage signals applied on the LC cell has to be changed continuously. Usually, a source driver is configured to generate such voltage signals having their polarity alternated according to an inversion scheme such as frame inversion, row inversion, column inversion, dot inversion, or 2-line inversion.

Typically, the display quality of an image in a dot inversion or a 2-line inversion is better than that in other inversion schemes; however, the power consumption is higher comparing to that in the other inversion schemes. The column invention may result in a low consumption of power, but there are issues such as crosstalks and vertical flickers. For a zig-zag arrangement of pixels, the display quality of an image is similar to that of the dot inversion, while its power consumption is similar to that of the column invention. However, crosstalks and horizontal bright and dark lines may occur in the zig-zag scheme.

Therefore, a heretofore unaddressed need exists in the art to address the aforementioned deficiencies and inadequacies.

SUMMARY OF THE INVENTION

In one aspect, the present invention relates to a source driver for driving a display panel to display an image data in an adaptive column inversion, where the display panel comprises a plurality of pixels spatially arranged in a matrix form and a plurality of data lines, each data line being associated with pixels of a corresponding pixel column, where the image data is decomposed into a number of frames, and each frame of the image data is mapped onto the pixel matrix with grey levels such that a grey level associated with a pixel is corresponding to the shade of grey of the frame to be displayed at the pixel.

In one embodiment, the source driver includes a data processing unit adapted for determining the grey levels of the image data mapped onto the pixel matrix, a MUX coupled to the data processing unit and adapted for receiving a frame polarity control signal, FramePOL, and a pixel polarity control signal, XPOL, and outputting a polarity control signal, POL, that is corresponding one of FramePOL and XPOL according to the determined grey levels of the image data, and a switch module coupled to the MUX and controlled by the polarity control signal POL, a first digital-to-analog converter with a positive polarity (PDAC) adapted for receiving a first digital signal associated with the image data and converting the first digital signal into a first analog signal, a second digital-to-analog converter with a negative polarity (NDAC) adapted for receiving a second digital signal associated with the image data and converting the second digital signal into a second analog signal, a first operational amplifier coupled to the PDAC and the NDAC through the switch module and adapted for receiving one of the first analog signal from the PDAC and the second analog signal from the NDAC and outputting a first data signal to an odd data line of the plurality of data line, and a second operational amplifier coupled to the PDAC and the NDAC through the switch module and adapted for receiving the other of the first analog signal from the PDAC and the second analog signal from the NDAC and outputting a second data signal to an even data line of the plurality of data line.

In one embodiment, when the determined grey levels are greater than Lm or less than Ln, the polarity control signal POL is the frame polarity control signal FramePOL, and otherwise the polarity control signal POL is the pixel polarity control signal XPOL, where $0<Ln<Lm<Lmax$, and $Lmax=(2^n-1)$ being the maximal grey level of n bits.

In one embodiment, when the determined grey levels are greater than Lm or less than Ln, pixels of the pixel matrix associated with the determined grey levels are driven with a column inversion, and the other pixels of the pixel matrix are driven with one of a dot inversion and a 2-line inversion.

In one embodiment, the data processing unit comprises a logic circuit adapted for determining N most-significant bits (MSBs) of the image data mapped onto two neighboring data lines, such that when all of the N MSBs is equal to 1 or 0, the output of the logic circuit is 1, otherwise, the output of the logic circuit is 0, N being a positive integer, where when the output of the logic circuit is 1, the MUX selects the frame polarity control signal FramePOL, and when the output of the logic circuit is 0, the MUX selects the pixel polarity control signal POL. In one embodiment, N=4.

In one embodiment, the first and second analog signals have positive and negative polarities, respectively. The first and second data signals have positive and negative polarities, respectively.

In one embodiment, the polarity control signal POL has a low state and a high state, where when the polarity control signal POL is in the high state, each odd data line of the plurality of data line receives the first data signal, while each even data line of the plurality of data line receives the second data signal, and where when the polarity control signal POL is in the low state, each odd data line of the plurality of data line receives the second data signal, while each even data line of the plurality of data line receives the first data signal.

In another aspect, the present invention relates to a source driver for driving a display panel to display an image data in an adaptive column inversion, where the display panel comprises a plurality of pixels spatially arranged in a matrix form and a plurality of data lines, each data line being associated with pixels of a corresponding pixel column, where the image data is decomposed into a number of frames, and each frame of the image data is mapped onto the pixel matrix with grey levels such that a grey level associated with a pixel is corresponding to the shade of grey of the frame to be displayed at the pixel. In one embodiment, the source driver includes a data processing unit having a logic circuit adapted for determining N MSBs of image data signals mapped onto two neighboring data lines, such that when all of the N MSBs is equal to 1 or 0, the output of the logic circuit is 1, otherwise, the output of the logic circuit is 0, where N is a positive integer, and a MUX coupled to the data processing unit and adapted for receiving a frame polarity control signal, FramePOL, and a pixel polarity control signal, XPOL, and selectively outputting the frame polarity control signal FramePOL when the output of the logic circuit is 1, or the pixel polarity control signal POL when the output of the logic circuit is 0, as a polarity control signal, POL. When the MUX selects the frame polarity control signal FramePOL, pixels of the pixel matrix associated with the neighboring data lines are driven with a column inversion, while the other pixels of the pixel matrix are driven with one of a dot inversion and a 2-line inversion.

In one embodiment, the source driver further includes a switch module coupled to the MUX and controlled by the polarity control signal POL, a PDAC adapted for receiving a first digital signal associated with the image data and converting the first digital signal into a first analog signal, a NDAC adapted for receiving a second digital signal associated with the image data and converting the second digital signal into a second analog signal, a first operational amplifier coupled to the PDAC and the NDAC through the switch module and adapted for receiving one of the first analog signal from the PDAC and the second analog signal from the NDAC and outputting a first data signal to an odd data line of the plurality of data line, and a second operational amplifier coupled to the PDAC and the NDAC through the switch module and adapted for receiving the other of the first analog signal from the PDAC and the second analog signal from the NDAC and outputting a second data signal to an even data line of the plurality of data line.

In one embodiment, the first and second analog signals have positive and negative polarities, respectively. The first and second data signals have positive and negative polarities, respectively.

In one embodiment, the polarity control signal POL has a low state and a high state, where when the polarity control signal POL is in the high state, each odd data line of the plurality of data line receives the first data signal, while each even data line of the plurality of data line receives the second data signal, and where when the polarity control signal POL is in the low state, each odd data line of the plurality of data line receives the second data signal, while each even data line of the plurality of data line receives the first data signal.

In yet another aspect, the present invention relates to a method for driving a display panel to display an image data in an adaptive column inversion, where the display panel comprises a plurality of pixels spatially arranged in a matrix form and a plurality of data lines, each data line being associated with pixels of a corresponding pixel column. In one embodiment, the method comprises the steps of inputting an image data to be displayed, where the image data is decomposed into a number of frames, and each frame of the image data is mapped onto the pixel matrix with grey levels such that a grey level associated with a pixel is corresponding to the shade of grey of the frame to be displayed at the pixel, determining N MSBs of image data signals mapped onto two neighboring data lines, N being a positive integer, selecting a frame polarity control signal, FramePOL, when all of the N MSBs of the image data signals mapped onto the two neighboring data lines is equal to 1 or 0, or a pixel polarity control signal, XPOL, when the N MSBs comprise 1 and 0, as a polarity control signal, POL, and displaying the image data in a column inversion in pixels of the pixel matrix when the frame polarity control signal FramePOL is selected and in one of a dot inversion and a 2-line inversion in the other pixels of the pixel matrix when the pixel polarity control signal XPOL is selected. In one embodiment, N=4.

In one embodiment, the determining step is performed with a data processing unit having a logic circuit adapted such that when all of the N MSBs is equal to 1 or 0, the output of the logic circuit is 1, otherwise, the output of the logic circuit is 0, where N is a positive integer.

In one embodiment, the selecting step is performed with a MUX adapted such that when the output of the logic circuit is 1, the MUX selects the frame polarity control signal FramePOL, and when the output of the logic circuit is 0, the MUX selects the pixel polarity control signal POL.

In a further aspect, the present invention relates to a source driver for driving a display panel to display an image data in an adaptive column inversion, wherein the display panel comprises a plurality of pixels spatially arranged in a matrix form and a plurality of data lines, each data line being associated with pixels of a corresponding pixel column, wherein the image data is decomposed into a number of frames, and wherein each frame of the image data is mapped onto the pixel matrix with grey levels such that a grey level associated with a pixel is corresponding to the shade of grey of the frame to be displayed at the pixel.

In one embodiment, the source driver comprises a data processing unit having a logic circuit adapted for determining the grey levels of image data signals mapped onto each 2n neighboring data lines of the plurality of data lines, such that when the determined grey levels are greater than Lm or less than Ln, the output of the logic circuit is 1, otherwise, the output of the logic circuit is 0, wherein n is a positive integer, and wherein $0<Ln<Lm<Lmax$, and $Lmax=(2^k-1)$ being the maximal grey level of k bits.

Further, the source driver comprises a MUX coupled to the data processing unit and adapted for receiving a frame polarity control signal, FramePOL, and a pixel polarity control signal, XPOL, and selectively outputting the frame polarity control signal FramePOL when the output of the logic circuit is 1, or the pixel polarity control signal POL when the output of the logic circuit is 0, as a polarity control signal, POL, and a plurality of driver modules coupled to the MUX, each driver module adapted for receiving two corresponding image data signals and selectively outputting them to a corresponding odd data line and a corresponding even data line of the 2n neighboring data lines according to the control signal POL.

In one embodiment, the logic circuit comprises a plurality of EX-NOR gates and an AND gate coupled to the plurality of EX-NOR gates, adapted for determining N most-significant bits (MSBs) of the image data signals mapped onto each 2n neighboring data lines, such that when all of the N MSBs are equal to 1 or 0, the output of the logic circuit is 1, otherwise, the output of the logic circuit is 0, wherein N is a positive integer.

In one embodiment, the driver module has a switch module coupled to the MUX and controlled by the polarity control signal POL, a first digital-to-analog converter with a positive polarity (PDAC) adapted for receiving a first digital signal associated with the image data and converting the first digital signal into a first analog signal, a second digital-to-analog converter with a negative polarity (NDAC) adapted for receiving a second digital signal associated with the image data and converting the second digital signal into a second analog signal, a first operational amplifier coupled to the PDAC and the NDAC through the switch module and adapted for receiving one of the first analog signal from the PDAC and the second analog signal from the NDAC and outputting a first data signal to an odd data line of the plurality of data line, and a second operational amplifier coupled to the PDAC and the NDAC through the switch module and adapted for receiving the other of the first analog signal from the PDAC and the second analog signal from the NDAC and outputting a second data signal to an even data line of the plurality of data line. In one embodiment, the first and second analog signals have positive and negative polarities, respectively. The first and second data signals have positive and negative polarities, respectively.

In one embodiment, when the MUX selects the frame polarity control signal FramePOL, pixels of the pixel matrix associated with the 2n neighboring data lines are driven with a column inversion, while the other pixels of the pixel matrix are driven with one of a dot inversion and a 2-line inversion.

When the determined grey levels are greater than Lm or less than Ln, the control signal POL is the frame polarity control signal FramePOL, and otherwise the polarity control signal POL is the pixel polarity control signal XPOL.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein:

FIG. 3 shows schematically an image displayed with (a) a 2-dot inversion and (b) an adaptive column inversion according to one embodiment of the present invention;

DETAILED DESCRIPTION OF THE INVENTION

Figure 1:
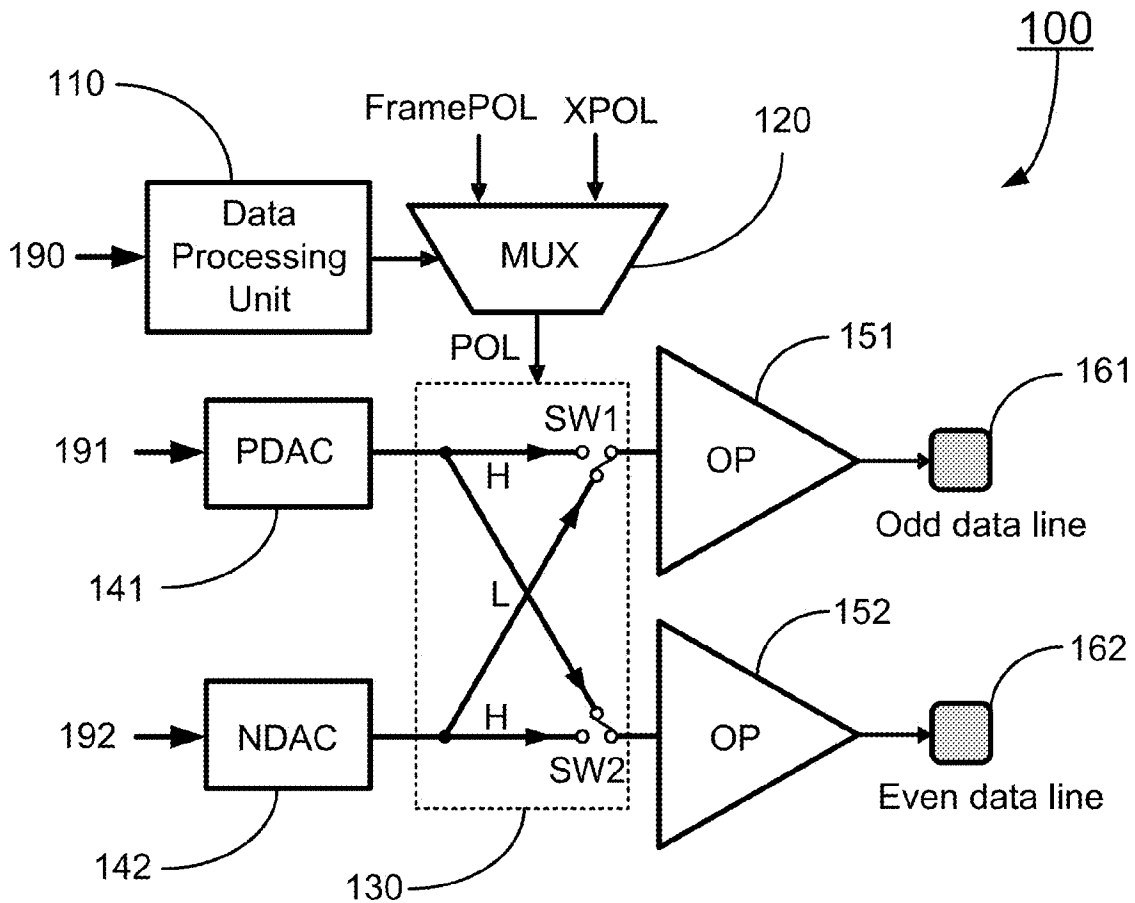
FIG. 1 shows schematically a block diagram of a source driver according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, the term "grey level" refers to one of (discrete) shades of grey for an image, or an amount of light perceived by a human for the image. If the brightness of the image is expressed in the form of shades of grey in n bits, n being an integer greater than zero, the grey level takes values from zero representing black, up to $(2^n-1)$ representing white, with intermediate values representing increasingly light shades of grey. In an LCD device, the amount of light that transmits through liquid crystals is adjusted to represent the grey level.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings of FIGS. 1-7. In accordance with the purposes of this invention, as embodied and broadly described herein, this invention, in one aspect, relates to a source driver for driving a display panel to display an image data in an adaptive column inversion. The display panel has a plurality of pixels spatially arranged in a matrix form and a plurality of data lines, each data line being associated with pixels of a corresponding pixel column. The image data is decomposed into a number of frames, where each frame of the image data is mapped onto the pixel matrix with grey levels such that a grey level associated with a pixel is corresponding to the shade of grey of the frame to be displayed at the pixel. In other words, the image data is processed by for example, a video device (not shown), into a plurality of image data signals expressed in the form of grey levels in k bits, and each image data signal is input to a corresponding data line for display in a pixel column associated with the corresponding data line. For example, for a 4-bit, an image data signal in a pixel can be expressed in one of $2^4$=64 grey levels depending the shades of grey of the image in the pixel.

Referring to FIG. 1, a source driver 100 is shown according to one embodiment of the present invention. The source driver 100 includes, among other components, a data processing unit 110, a MUX 120 coupled to the data processing unit 110, a switch module 130 coupled to the MUX 120, a first digital-to-analog converter with a positive polarity (PDAC) 141, a second digital-to-analog converter with a negative polarity (NDAC) 142, and a first operational amplifier 151 and a second operational amplifier 152 coupled to the PDAC 141 and the NDAC 142 through the switch module 130.

The data processing unit 110 is adapted for determining the grey levels of the image data 190 mapped onto the pixel matrix, so as to select one or more inversion driving methods to drive the display panel to display the image. In one embodiment, the data processing unit 110 determines the grey levels of image data signals 190 associated with (or input to) two neighboring data lines 171 and 172. Alternatively, as shown below, the data processing unit 110 determines N most-significant bits (MSBs) of the image data signals 190.

The MUX 120 is adapted for receiving a frame polarity control signal, FramePOL, and a pixel polarity control signal, XPOL, and outputting a polarity control signal, POL, that is corresponding one of FramePOL and XPOL according to the determined grey levels of the image data. For example, when the determined grey levels are greater than Lm or less than Ln, the polarity control signal POL is the frame polarity control signal FramePOL, and otherwise the polarity control signal POL is the pixel polarity control signal XPOL, where $0<Ln<Lm<Lmax$, and $Lmax=(2^k-1)$ being the maximal grey level of k bits. Ln and Lm are two predetermined grey levels. Alternatively, when the determined grey levels are greater than Lm or less than Ln, pixels of the pixel matrix associated with the determined grey levels are driven with a column inversion, and the other pixels of the pixel matrix are driven with one of a dot inversion and a 2-line inversion. The pixel polarity control signal XPOL is generated from a timing controller (T-con, not shown) and used to determine a data inversion scheme.

The switch module 130 may includes a pair of switches SW1 and SW2 that are coupled to the PDAC 141, the NDAC 142, the first operational amplifier 151 and the second operational amplifier 152 and controlled by the polarity control signal POL. For example, when the polarity control signal POL is in a high state (H), the output signals of the PDAC 141, the NDAC 142 are respectively delivered to the first operational amplifier 151 and the second operational amplifier 152. Otherwise, when the polarity control signal POL is in a low state (L), the output signals of the PDAC 141, the NDAC 142 are respectively delivered to the second operational amplifier 152 and the first operational amplifier 151.

The PDAC 141 is adapted for receiving a first digital signal 191 of the image data and converting the first digital signal 191 into a first analog signal. The NDAC 142 is adapted for receiving a second digital signal 192 of the image data and converting the second digital signal 192 into a second analog signal. The image data 190 and the first digital signal 191 and the second digital signal 192 are processed of the image to be displayed. In one embodiment, the image data 190 includes at least the first digital signal 191 and the second digital signal 192. The first and second analog signals have positive and negative polarities, respectively. The first operational amplifier 151 and the second operational amplifier 152 are coupled to the PDAC 141 and the NDAC 142 through the switch module 130. The first operational amplifier 151 is adapted for receiving one of the first analog signal from the PDAC 141 and the second analog signal from the NDAC 142, and outputting a first data signal to an odd data line 161, while the second operational amplifier 152 is adapted for receiving the other of the first analog signal from the PDAC 141 and the second analog signal from the NDAC 142 and outputting a second data signal to an even data line 162. The first and second data signals have positive and negative polarities, respectively.

In operation, when the polarity control signal POL is in the high state (H), the odd data line 161 receives the first data signal, while the even data line 162 receives the second data signal, and when the polarity control signal POL is in the low state (L), the odd data line 161 receives the second data signal, while the even data line 162 receives the first data signal.

Figure 2:
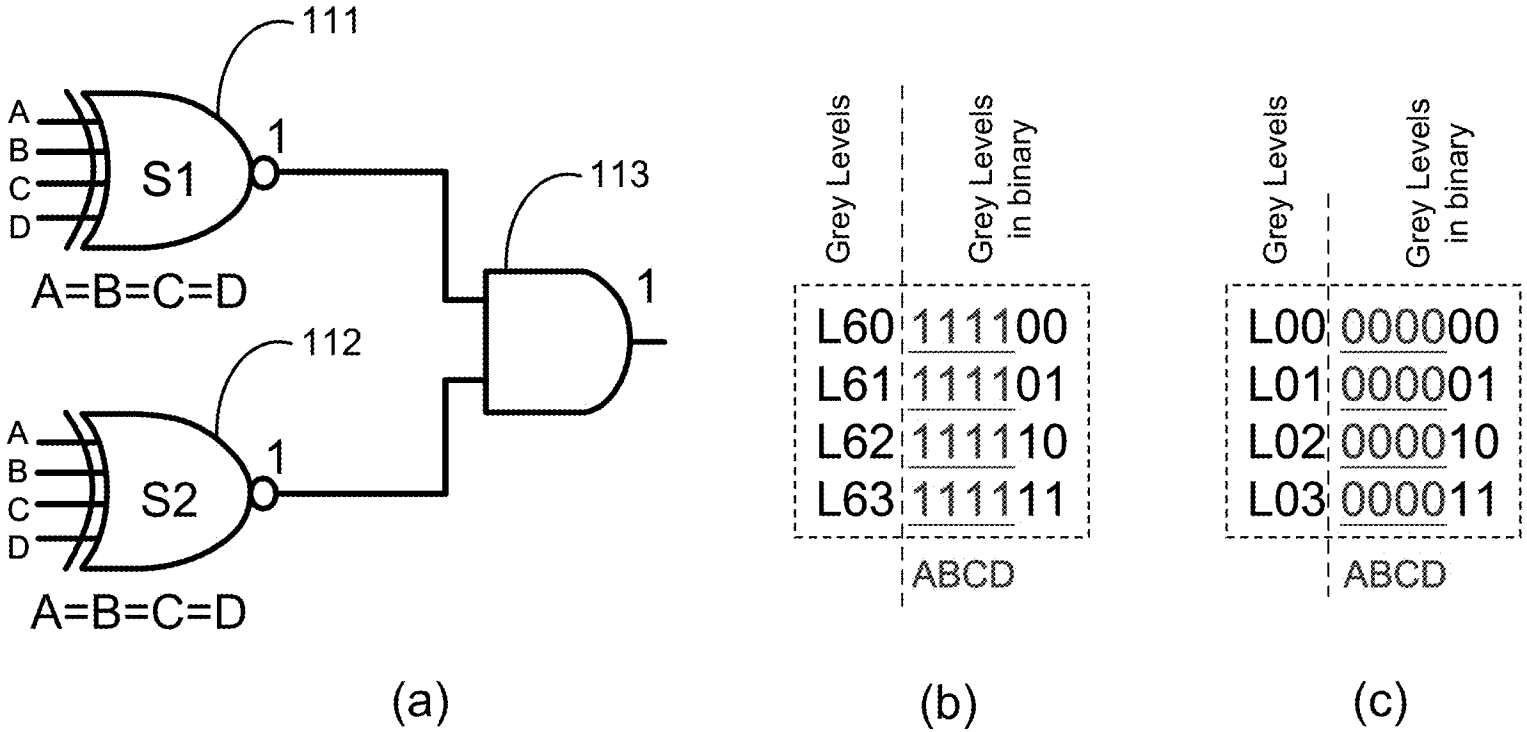
FIG. 2 shows schematically (a) a logic circuit of the source driver, and (b) and (c) most-significant bits of grey levels of an image signal to be displayed.

In one embodiment, the data processing unit 110 includes a logic circuit for determining N MSBs of the image data mapped onto two neighboring data lines. As shown in FIG. 2(*a*), the logic circuit includes a first EX-NOR gate 111, a second EX-NOR gate 112 and an AND gate 113 coupled to each other. In the exemplary embodiment, N=4. The output of the first EX-NOR gate 111 (or the second EX-NOR gate 112) is true, indicated by 1, only when all of four inputs are the same, i.e., all of the four inputs are 0 or all of the four inputs are 1 in the binary. Otherwise, it is false. Additionally, the output of the AND gate 113 is true, indicated by 1, only when all of the outputs of the first EX-NOR gate 111 and the second EX-NOR gate 112 are true (1). The first EX-NOR gate 111 and the second EX-NOR gate 112 are utilized to determine four (4) MSBs of data signals of two neighboring data lines, respectively.

When all of the four MSBs, indicated by A, B, C and D, respectively, of the data signals are equal to 1, as shown in FIG. 2(*b*) or 0, as shown in FIG. 2(*c*), the output of the logic circuit is true, indicated by 1. Otherwise, the output of the logic circuit is false, indicated by 0. When the output of the logic circuit is true, 1, the MUX selects the frame polarity control signal FramePOL as the polarity control signal POL, i.e., a column inversion. When the output of the logic circuit is false, the MUX selects the pixel polarity control signal XPOL as the polarity control signal POL, i.e., a dot inversion or a 2-dot inversion.

FIG. 3(*a*) shows schematically an image displayed with a 2-dot inversion. FIG. 3(*b*) shows schematically the image displayed with an adaptive column inversion, that is, S1 and S2 columns are in the column inversion, and S3 and S4 column are in the 2-dot inversion.

Figure 4:
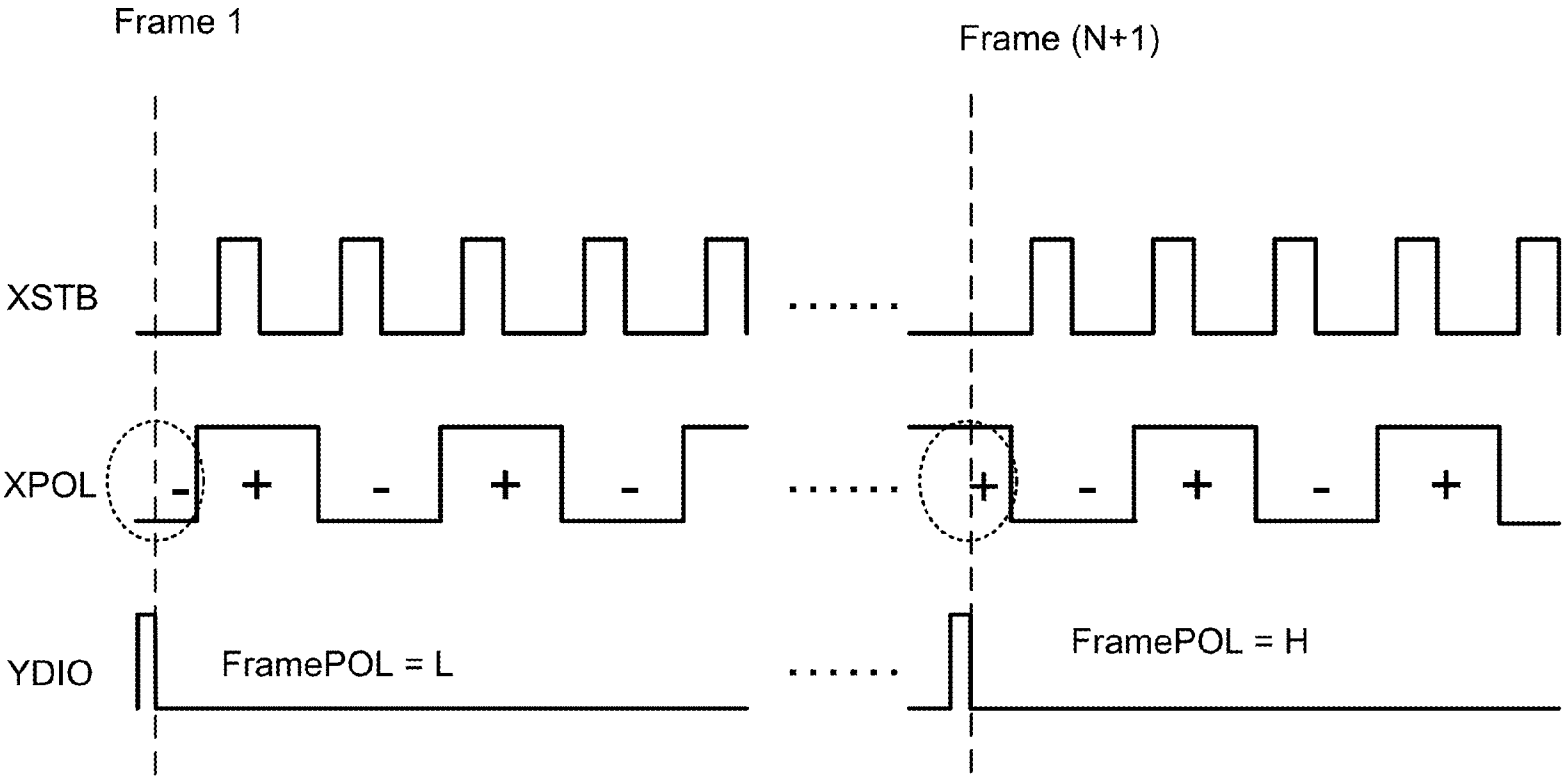
FIG. 4 shows schematically time charts of driving signals according to one embodiment of the present invention.

Referring to FIG. 4, time charts of driving/control signals are shown according to one embodiment of the present invention. In the charts, YDIO is corresponding to a start pulse of image frames. Each frame has a polarity, FramePOL, which is opposite to that of its immediately prior and/or next frame. In other words, FramePOL changes every frame. XSTB rising edge latch XPOL determines the polarity of each horizontal line.

Figure 5:
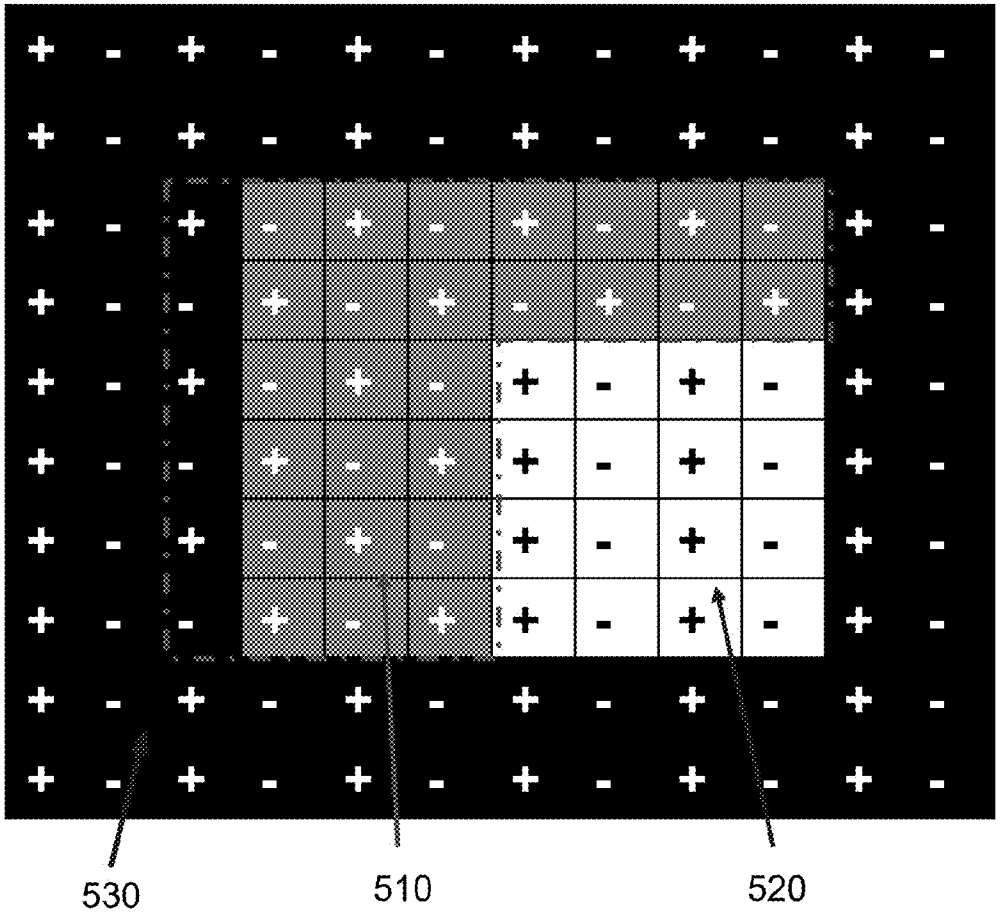
FIG. 5 shows schematically one frame of an image displayed with an adaptive column inversion according to one embodiment of the present invention.
Figure 6:
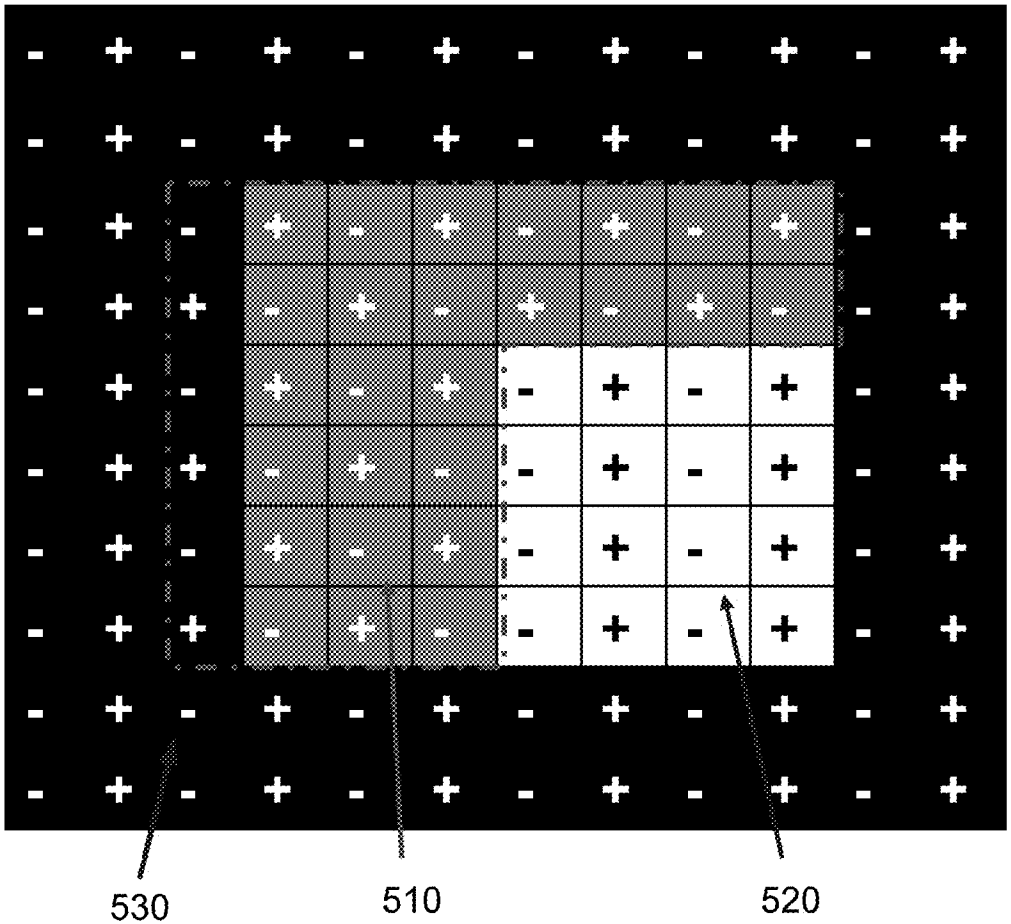
FIG. 6 shows schematically another frame of the image displayed with the adaptive column inversion.

FIGS. 5 and 6 are two consecutive frames of an image displayed with an adaptive column inversion. The grey levels of the image in area 520 are near or close to the maximal grey level, i.e., greater than a predetermined value, for example, Lm=L59, FramePOL is adapted to control the PDAC, the NDAC, the first and second operational amplifiers, accordingly, the image is displayed in a column inversion. Further, the grey levels of the image in area 530 are near or close to the minimal grey level, i.e., less than a predetermined value, for example, Ln=L4, FramePOL is adapted to control the PDAC, the NDAC, the first and second operational amplifiers, accordingly, the image is displayed in a column inversion. However, when the grey levels of the image are between Ln=L4 and Lm=L59, XPOL is adapted to control the PDAC, the NDAC, the first and second operational amplifiers, accordingly, the image is displayed in a 2-dot column inversion, as indicated in area 510.

In another aspect, the present invention relates to a method for driving a display panel to display an image data in an adaptive column inversion. In one embodiment, the method includes the following steps: at first, an image data to be displayed is provided. The image data is decomposed into a number of frames, where each frame of the image data is mapped onto the pixel matrix with grey levels such that a grey level associated with a pixel is corresponding to the shade of grey of the frame to be displayed at the pixel.

Then, N MSBs of image data signals mapped onto two neighboring data lines are determined.

Next, when all of the N MSBs of the image data signals mapped onto the two neighboring data lines is equal to 1 or 0, a frame polarity control signal FramePOL is selected as a polarity control signal POL, or when the N MSBs comprise 1 and 0, a pixel polarity control signal XPOL is selected as the polarity control signal, POL.

The image data is displayed in a column inversion in pixels of the pixel matrix when the frame polarity control signal FramePOL is selected and in one of a dot inversion and a 2-line inversion in the other pixels of the pixel matrix when the pixel polarity control signal XPOL is selected.

In one embodiment, the determining step is performed with a data processing unit having a logic circuit adapted such that when all of the N MSBs is equal to 1 or 0, the output of the logic circuit is 1, otherwise, the output of the logic circuit is 0, wherein N is a positive integer. The selecting step is performed with a MUX adapted such that when the output of the logic circuit is 1, the MUX selects the frame polarity control signal FramePOL, and when the output of the logic circuit is 0, the MUX selects the pixel polarity control signal POL.

Figure 7:
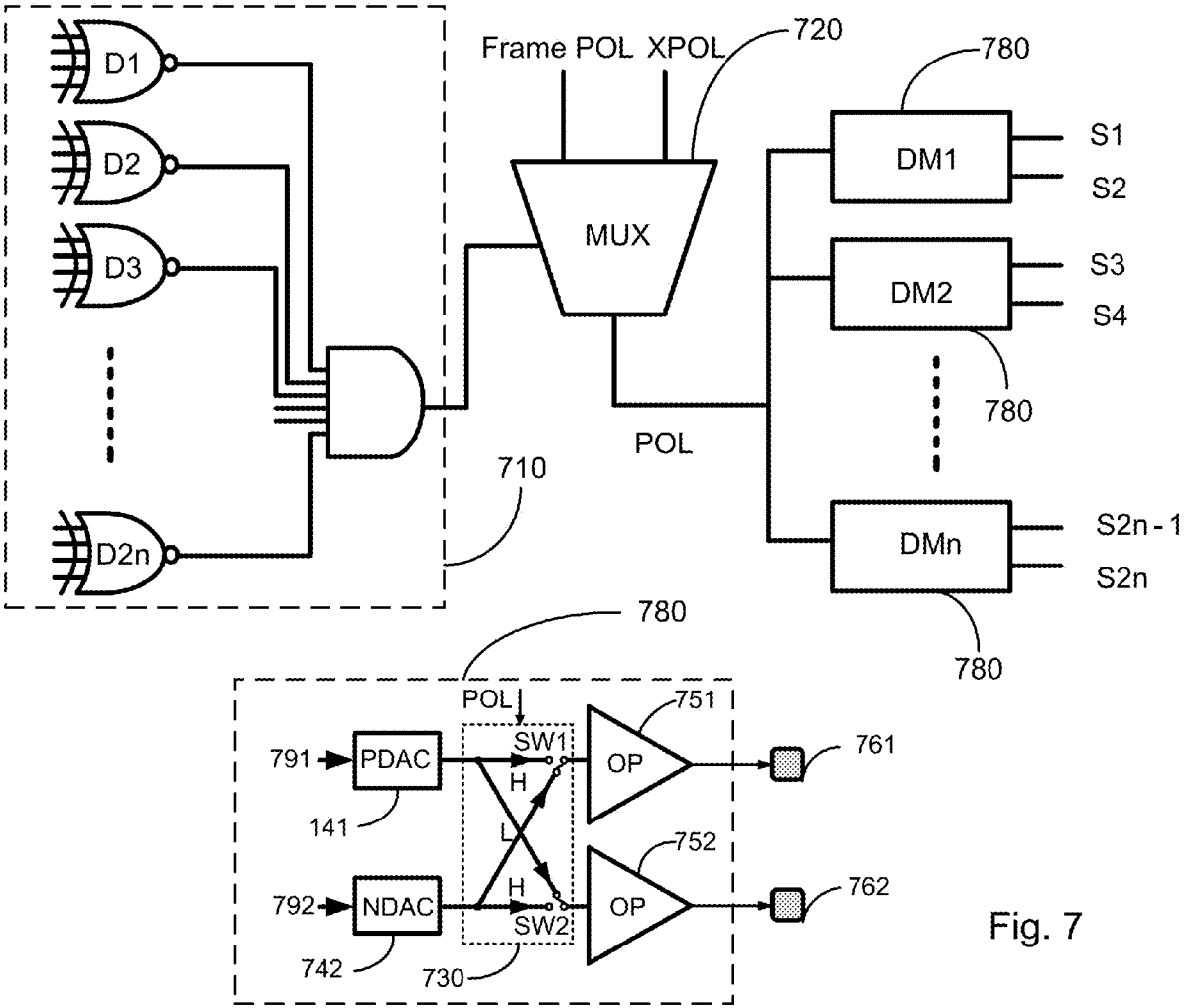
FIG. 7 shows schematically a block diagram of a source driver according to another embodiment of the present invention.

FIG. 7 shows schematically a block diagram of a source driver 700 according to another embodiment of the present invention. In this embodiment, the source driver 700 comprises a data processing unit 710, a MUX 720 coupled to the data processing unit 710, and a plurality of driver modules, DM1, DM2, . . . , DMn, 780 coupled to the MUX 720.

The data processing unit 710 included a logic circuit adapted for determining the grey levels of image data signals mapped onto each 2n neighboring data lines, S1, S2, . . . , S2*n*, of the plurality of data lines, such that when the determined grey levels are greater than Lm or less than Ln, the output of the logic circuit is 1, otherwise, the output of the logic circuit is 0, where n is a positive integer, and $0<Ln<Lm<Lmax$, and $Lmax=(2^k-1)$ being the maximal grey level of k bits.

As shown in FIG. 7, the logic circuit includes 2n EX-NOR gates, D1, D2, . . . , D2*n*, and an AND gate coupled to the 2n EX-NOR gates, D1, D2, . . . , D2*n*. Each EX-NOR gate is configured to receive a corresponding image data signal and output 0 or 1 based on the input image data signal. Specifically, if all of N most-significant bits (MSBs) of the input image data signal are equal to 1, or 0, the EX-NOR gate outputs 1, otherwise, it outputs 0. When all of N most-significant bits (MSBs) of the input image data signal are equal to 1, the grey levels of the input image data signal are greater than Lm. When all of N most-significant bits (MSBs) of the input image data signal are equal to 0, the grey levels of the input image data signal are less than Ln.

For such a logic circuit, when each and every EX-NOR gate outputs 1 or 0, the output of the logic circuit is 1, otherwise, the output of the logic circuit is 0.

The MUX 720 is coupled to the logic circuit and adapted for receiving a frame polarity control signal, FramePOL, and a pixel polarity control signal, XPOL. When the output of the logic circuit is 1, the MUX 720 selects the frame polarity control signal FramePOL as the polarity control signal POL, i.e., a column inversion. When the output of the logic circuit is 0, the MUX 720 selects the pixel polarity control signal XPOL as the polarity control signal POL, i.e., a dot inversion or a 2-dot inversion.

Each driver module 780 is adapted for receiving two corresponding image data signals 791 and 792 and selectively outputting them to a corresponding odd data line 761 and a corresponding even data line 762 of the 2n neighboring data lines, S1, S2, . . . , S2*n*, according to the control signal POL. The corresponding odd data line 761 is one of S1, S3, . . . , S2*n*−1, while the corresponding even data line 762 if one of S2, S4, . . . , S2*n*.

The driver module 780 has a switch module 730 coupled to the MUX 720, a first digital-to-analog converter with a positive polarity (PDAC) 741, a second digital-to-analog converter with a negative polarity (NDAC) 742, and a first operational amplifier 751 and a second operational amplifier 752 coupled to the PDAC 741 and the NDAC 742 through the switch module 730.

The switch module 730 may includes a pair of switches SW1 and SW2 that are coupled to the PDAC 741, the NDAC 742, the first operational amplifier 751 and the second operational amplifier 752 and controlled by the polarity control signal POL. For example, when the polarity control signal POL is in a high state (H), the output signals of the PDAC 741, the NDAC 742 are respectively delivered to the first operational amplifier 751 and the second operational amplifier 752. Otherwise, when the polarity control signal POL is in a low state (L), the output signals of the PDAC 741, the NDAC 742 are respectively delivered to the second operational amplifier 752 and the first operational amplifier 751.

The PDAC 741 is adapted for receiving a first digital signal 791 of the image data and converting the first digital signal 791 into a first analog signal. The NDAC 742 is adapted for receiving a second digital signal 792 of the image data and converting the second digital signal 792 into a second analog signal. The image data 790 and the first digital signal 791 and the second digital signal 792 are processed of the image to be displayed. In one embodiment, the image data 790 includes at least the first digital signal 791 and the second digital signal 792. The first and second analog signals have positive and negative polarities, respectively. The first operational amplifier 751 and the second operational amplifier 752 are coupled to the PDAC 741 and the NDAC 742 through the switch module 730. The first operational amplifier 751 is adapted for receiving one of the first analog signal from the PDAC 741 and the second analog signal from the NDAC 742, and outputting a first data signal to an odd data line 761, while the second operational amplifier 752 is adapted for receiving the other of the first analog signal from the PDAC 741 and the second analog signal from the NDAC 742 and outputting a second data signal to an even data line 762. The first and second data signals have positive and negative polarities, respectively.

In operation, when the MUX selects the frame polarity control signal FramePOL, pixels of the pixel matrix associated with the 2n neighboring data lines S1, S2, . . . , S2*n*, are driven with a column inversion, while the other pixels of the pixel matrix are driven with one of a dot inversion and a 2-line inversion.

According to the present invention, the display quality of an image in a display device can be substantially improved, while the power consumption can be reduced significantly.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A source driver for driving a display panel to display an image data in an adaptive column inversion, wherein the display panel comprises a plurality of pixels spatially arranged in a matrix form and a plurality of data lines, each data line being associated with pixels of a corresponding pixel column, wherein the image data is decomposed into a number of frames, and wherein each frame of the image data is mapped onto the pixel matrix with grey levels such that a grey level associated with a pixel is corresponding to a shade of grey of the frame to be displayed at the pixel, comprising:

(a) a data processing unit adapted for determining the grey levels of the image data mapped onto the pixel matrix;

(b) a MUX coupled to the data processing unit and adapted for receiving a frame polarity control signal, FramePOL, and a pixel polarity control signal, XPOL, and outputting a polarity control signal, POL, that is corresponding one of FramePOL and XPOL according to the determined grey levels of the image data;

(c) a switch module coupled to the MUX and controlled by the polarity control signal POL;

(d) a first digital-to-analog converter with a positive polarity (PDAC) adapted for receiving a first digital signal associated with the image data and converting the first digital signal into a first analog signal;

(e) a second digital-to-analog converter with a negative polarity (NDAC) adapted for receiving a second digital signal associated with the image data and converting the second digital signal into a second analog signal;

(f) a first operational amplifier coupled to the PDAC and the NDAC through the switch module and adapted for receiving one of the first analog signal from the PDAC and the second analog signal from the NDAC and outputting a first data signal to an odd data line of the plurality of data line; and (g) a second operational amplifier coupled to the PDAC and the NDAC through the switch module and adapted for receiving other of the first analog signal from the PDAC and the second analog signal from the NDAC and outputting a second data signal to an even data line of the plurality of data line, wherein when the determined grey levels are greater than Lm or less than Ln, the polarity control signal POL is the frame polarity control signal FramePOL, and otherwise the polarity control signal POL is the pixel polarity control signal XPOL, and wherein $0 < Ln < Lm < Lmax$, and $Lmax = (2^n - 1)$ being a maximal grey level of n bits; and wherein when the determined grey levels are greater than Lm or less than Ln, pixels of the pixel matrix associated with the determined grey levels are driven with a column inversion, and other pixels of the pixel matrix are driven with one of a dot inversion and a 2-line inversion.

2. The source driver of claim 1, wherein the data processing unit comprises a logic circuit adapted for determining N most-significant bits (MSBs) of the image data mapped onto two neighboring data lines, such that when all of the N MSBs is equal to 1 or 0, an output of the logic circuit is 1, otherwise, the output of the logic circuit is 0, wherein N is a positive integer.

3. The source driver of claim 2, wherein N =4.

4. The source driver of claim 2, wherein when the output of the logic circuit is 1, the MUX selects the frame polarity control signal FramePOL, and when the output of the logic circuit is 0, the MUX selects the pixel polarity control signal POL.

5. The source driver of claim 1, wherein the first and second analog signals have positive and negative polarities, respectively.

6. The source driver of claim 1, wherein the first and second data signals have positive and negative polarities, respectively.

7. The source driver of claim 6, wherein the polarity control signal POL has a low state and a high state, wherein when the polarity control signal POL is in the high state, each odd data line of the plurality of data line receives the first data signal, while each even data line of the plurality of data line receives the second data signal, and wherein when the polarity control signal POL is in the low state, each odd data line of the plurality of data line receives the second data signal, while each even data line of the plurality of data line receives the first data signal.

8. A source driver for driving a display panel to display an image data in an adaptive column inversion, wherein the display panel comprises a plurality of pixels spatially arranged in a matrix form and a plurality of data lines, each data line being associated with pixels of a corresponding pixel column, wherein the image data is decomposed into a number of frames, and wherein each frame of the image data is mapped onto the pixel matrix with grey levels such that a grey level associated with a pixel is corresponding to a shade of grey of the frame to be displayed at the pixel, comprising:

(a) a data processing unit having a logic circuit adapted for determining N most-significant bits (MSBs) of image data signals mapped onto two neighboring data lines, such that when all of the N MSBs are equal to 1 or 0, an output of the logic circuit is 1, otherwise, the output of the logic circuit is 0, wherein N is a positive integer; and (b) a MUX coupled to the data processing unit and adapted for receiving a frame polarity control signal, FramePOL, and a pixel polarity control signal, XPOL, and selectively outputting the frame polarity control signal FramePOL when the output of the logic circuit is 1, or the pixel polarity control signal POL when the output of the logic circuit is 0, as a polarity control signal, $POL_L$ wherein when the MUX selects the frame polarity control signal FramePOL, pixels of the pixel matrix associated with the neighboring data lines are driven with a column inversion, while other pixels of the pixel matrix are driven with one of a dot inversion and a 2-line inversion.

9. The source driver of claim 8, further comprising:

(a) a switch module coupled to the MUX and controlled by the polarity control signal POL;

(b) a first digital-to-analog converter with a positive polarity (PDAC) adapted for receiving a first digital signal associated with the image data and converting the first digital signal into a first analog signal;

(c) a second digital-to-analog converter with a negative polarity (NDAC) adapted for receiving a second digital signal associated with the image data and converting the second digital signal into a second analog signal;

(d) a first operational amplifier coupled to the PDAC and the NDAC through the switch module and adapted for receiving one of the first analog signal from the PDAC and the second analog signal from the NDAC and outputting a first data signal to an odd data line of the plurality of data line; and (e) a second operational amplifier coupled to the PDAC and the NDAC through the switch module and adapted for receiving other of the first analog signal from the PDAC and the second analog signal from the NDAC and outputting a second data signal to an even data line of the plurality of data line.

10. The source driver of claim 9, wherein the first and second analog signals have positive and negative polarities, respectively.

11. The source driver of claim 9 wherein the first and second data signals have positive and negative polarities, respectively.

12. The source driver of claim 9, wherein the polarity control signal POL has a low state and a high state, wherein when the polarity control signal POL is in the high state, each odd data line of the plurality of data line receives the first data signal, while each even data line of the plurality of data line receives the second data signal, and wherein when the polarity control signal POL is in the low state, each odd data line of the plurality of data line receives the second data signal, while each even data line of the plurality of data line receives the first data signal.

13. A source driver for driving a liquid crystal display (LCD), the LCD including a plurality of pixels spatially arranged as a matrix having a plurality of rows and a plurality of columns, the LCD further including a plurality of data lines, each data line being associated with a respective column of pixels, the source driver comprising:

(a) means for inputting an image to be displayed on the LCD, the image comprising a plurality of frames, each frame comprising a plurality of data signals, each data signal indicating a grey level associated with a respective pixel in the LCD;

(b) a data processing unit configured to compare each pair of data signals in a frame corresponding to two neighboring columns in a row to a first value and a second value, and to output a logic value of 1 if each of the pair of data signals indicates a grey level that is higher than the first value or lower than the second value, or to output a logic value of 0 if at least one of the pair of data signals indicates a grey level that is lower than or equal to the first value and higher than or equal to the second value;

(c) a selector coupled to the data processing unit, wherein the selector is configured to select a first polarity control signal in response to receiving a logic 1 from the data processing unit, or to select a second polarity control signal that is different from the first polarity control signal in response to receiving a logic 0 from the data processing unit; and (d) a data converter coupled to the selector, wherein the data converter is configured to convert one of the pair of data signals to a positive data signal and other one of the pair of data signals to a negative data signal, and to output pair of converted data signals to two corresponding data lines, and wherein the data converter is further configured to invert polarities of the pair of data signals in response to the first polarity control signal or the second polarity control signal selected by the selector, wherein each data signal comprises N bits, where N is a positive integer, and wherein the data processing unit includes two exclusive NOR (XNOR) logic circuits and an AND logic circuit, each XNOR circuit being configured to receive the M most-significant-bits of a corresponding one of the pair of data signals as inputs, where M is a positive integer less than N, and the AND circuit being configured to receive outputs of the two XNOR circuits as inputs and to output a logic 1 or 0 to the selector.

14. The source driver of claim 13, wherein the first polarity control signal is configured to cause the data converter to invert the polarities of the pair of data signals from one frame to a next frame.

15. The source driver of claim 14, wherein the second polarity control signal is configured to cause the data converter to invert the polarities of the pair of data signals from one row to a next row.

16. The source driver of claim 14, wherein the second polarity control signal is configured to cause the data converter to invert the polarities of the pair of data signals every integer multiple of rows.

17. The source driver of claim 16, wherein the integer is equal to two.

18. The source driver of claim 13, wherein the data converter includes a positive digital-to-analog converter and a negative digital-to-analog converter configured to convert one of the pair of data signals to a positive analog signal and the other one of the pair of data signals to a negative analog signal, respectively.

19. The source driver of claim 18, wherein the data converter further includes two operational amplifiers, each operational amplifier configured to receive an analog signal from a corresponding digital-to-analog converter and to output an amplified analog signal to a corresponding data line.

* * * * *